United States Patent [19]

Seidel et al.

[11] Patent Number: 4,694,655

[45] Date of Patent: Sep. 22, 1987

[54] CONTROLLABLE HELIUM-II PHASE SEPARATOR

[75] Inventors: Albert Seidel, Siegertsbrunn; Werner Malburg, Neubiberg, both of Fed. Rep. of Germany

[73] Assignee: Messerschmitt-Bölkow-Blohm GmbH, Munich, Fed. Rep. of Germany

[21] Appl. No.: 895,802

[22] Filed: Aug. 12, 1986

[30] Foreign Application Priority Data

Aug. 23, 1985 [DE] Fed. Rep. of Germany ..... 3530168

[51] Int. Cl.[4] ..... F17C 13/02

[52] U.S. Cl. ..... 62/51; 63/383; 63/514 R; 165/32

[58] Field of Search ..... 62/51, 383, 514 R; 165/32

[56] References Cited

U.S. PATENT DOCUMENTS

| | | | |
|---|---|---|---|
| 2,934,910 | 5/1960 | Tayler | 62/383 |
| 2,983,106 | 5/1961 | Kugler | 62/383 |
| 3,225,820 | 12/1965 | Riordan | 62/383 |
| 3,845,636 | 11/1974 | Van Mal et al. | 62/514 R |
| 3,992,893 | 11/1976 | Claudet et al. | 62/514 R |
| 4,305,261 | 12/1981 | Becker et al. | 62/514 R |
| 4,450,693 | 5/1984 | Green et al. | 62/514 R |
| 4,607,490 | 8/1986 | Seidel et al. | 62/514 R |

*Primary Examiner*—Ronald C. Capossela

*Attorney, Agent, or Firm*—Kenyon & Kenyon

[57] ABSTRACT

A controllable helium-II phase separator utilizes the cut-off action of the thermomechanical effect if superfluid helium-II flows through a capillary gap-shaped canal. For controlling the throughput, the gap width of the canal is varied by changing the distance between two opposite canal walls at least in the range between 0 and 15 μm.

5 Claims, 4 Drawing Figures

CONTROLLABLE HELIUM-II PHASE SEPARATOR

BACKGROUND OF THE INVENTION

The present invention relates to a controllable helium-II phase separator, in which superfluid helium-II flows, utilizing the cut-off action of the thermomechanical effect, through at least one capillary gap-shaped canal, the geometry of which can be varied for throughput control by means of at least one control element.

Such a phase separator is known from DE-AS No. 28 06 829 as well as from Research Report BFMT-FB No. 79/47 "Phase Separation of Helium-II in the Weightless State" by Denner et al., FU Berlin. This phase separator consists of a so-called ring gap valve, in which a cylindrical valve element opposite the valve sleeve has a passage gap with a gap width of less than 10 μm and wherein the gap length is varied by axially moving the valve element relative to the valve bushing. In such a phase separator, the cylindrical surfaces of the valve element and the sleeve must be machined highly precisely and be aligned coaxially by means of a separate guide; in addition, the coefficients of expansion of the materials must be matched to each other perfectly, since otherwise there is danger of jamming because of the small gap width. Furthermore, an additional valve or at least additional sealing surfaces at the valve element and at the valve sleeve are required in order to permit complete closure.

SUMMARY OF THE INVENTION

It is an object of the invention to provide a controllable helium-II phase separator, with which throughput control down to the amount zero is possible and which is less complicated and trouble-prone than the present Helium-II phase separator.

The above and other objects of the invention are achieved by a controllable helium-II phase separator, in which superfluid helium-II flows, utilizing the cut-off action of the thermomechanical effect, through at least one capillary gapshaped canal, the geometry of which can be varied for throughput control by means of at least one control element, wherein the gap width of at least one canal can be changed by varying the distance between two opposite canal walls at least in the range between 0 and 15 μm.

BRIEF DESCRIPTION OF THE DRAWINGS

The invention will be described in the following detailed description with reference to the drawings, in which.

DETAILED DESCRIPTION

Figure 1:
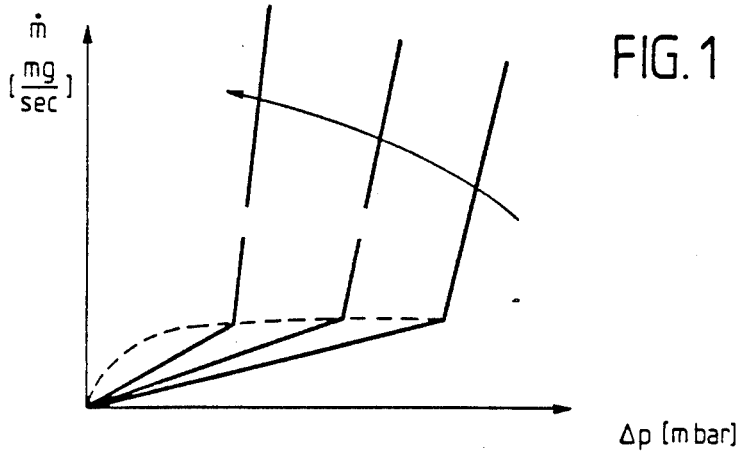
FIG. 1 shows a flow diagram for helium-II.

FIG. 1 shows the qualitative relationship between the throughput $\dot{m}$ of superfluid helium-II flowing in a gap with the gap width s and the pressure drop Δp along the gap. Accordingly, there are two flow regions indicated by dashed lines for the He-passage through narrow gaps, a narrow, socalled "linear region" with a flat, approximately linear slope of the curve, and an upper, so-called "Gorter-Mellink region" with a substantially steeper slope of the curve. In the "ideal region," only gaseous helium still leaves the gap. In the "Gorter-Mellink region," a mixture of gaseous and liquid helium is discharged. According to the invention described in the following, the gap width s is varied by the phase separator, so that a very accurate control of the throughput in the "ideal region" is possible. The throughput $\dot{m}$ for helium-II in the ideal region is:

$$\dot{m} = b\frac{\rho s^3}{12n}\cdot\frac{S\cdot T}{ST+L}\cdot\frac{\Delta p}{1}$$

where b = gap width transversely to the flow direction,
s = gap width (0 to 15 μm); perpendicular to b
ρ = density of the helium-II;
n = viscosity of the helium-II;
S = entropy of the helium-II;
T = temperature of the liquid helium-II;
L = latent heat of evaporation;
Δp = pressure drop along the gap and
1 = gap length in the flow direction.

As can be seen from the formula above, the throughput is proportional to the third power of the gap width s and the reciprocal value of the gap length 1. Contrary to the known solution, the present solution therefore utilizes the dependence of the gap width s on the third power with the gap length 1 constant. From this, the following advantages result:

If required, the throughput can also be made zero, i.e., the phase separator can also be shut off without other devices.

Because the gap width s enters with the third power, the control sensitivity is considerably greater than with a control of the gap length 1.

A disadvantage of the known solution, that when the throughput goes to infinity as 1 goes to zero, is avoided.

Because the region in which the gap width s is changed is small, a solid state drive, for instance, a piezoelectric drive can be used, in which the adjustments proceed entirely without friction.

Figure 2:
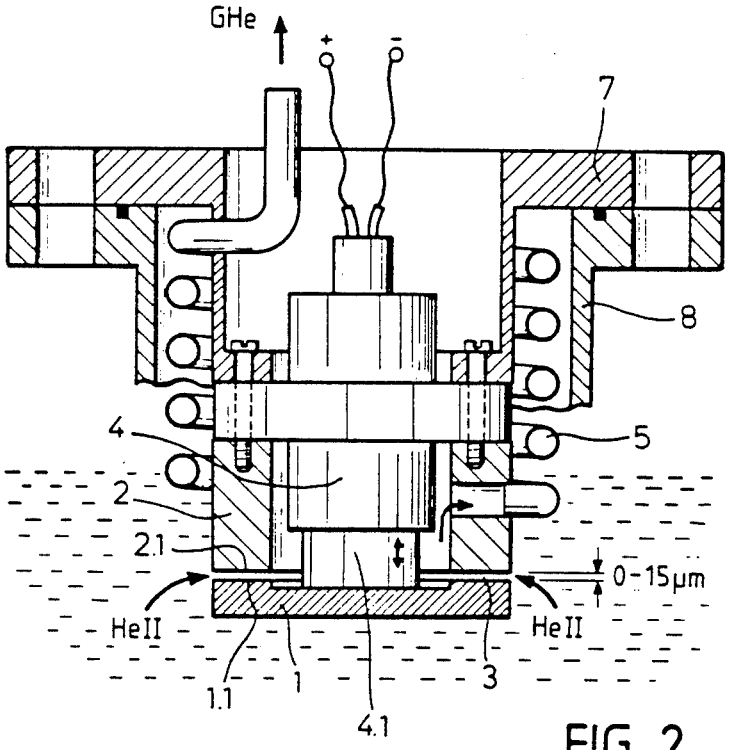
FIG. 2 shows a phase separator with a radial gap and a central control element.

In the embodiment shown in FIG. 2, the entire phase separator is fastened via a flange section 7 to a tank filled with superfluid helium-II by means of an appropriately designed tank nozzle 8. The phase separator comprises essentially a disc element 1 as well as a ring element 2, the free end face 2.1 of the ring element 2 together with an opposite surface 1.1 of the disc element 1 forming a radial gap 3. The disc element 1 is fastened to a control element 4.1 of a piezoelectric drive which is in turn connected to the ring element 2. The electric drive 4 can be a continuously variable drive or a drive operating in individual steps in the order of nanometers, for instance, a so-called "inch-worm," which allows an adjustment of the radial gap 3 in the range between 0 and at least 15 μm. The drive can optionally also be arranged outside the He-II tank at a different temperature level as constant as possible.

In this embodiment, the superfluid helium-II enters radially from the outside into the radial gap 3 and then flows into the interior formed by the ring element 2. Via a heat exchanger 5 connected to the interior, in which possible liquid which might have passed the gap is evaporated in the tank by heat exchange with the superfluid helium-II, the gaseous helium flows off and can be conducted due to its residual heat, for instance, through the heat insulating system of a cryostat.

Figure 3:
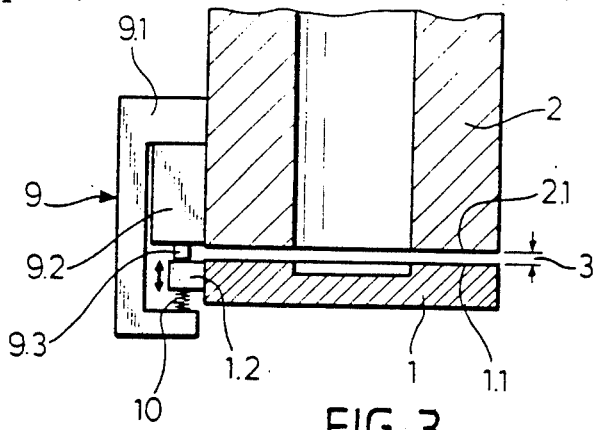
FIG. 3 shows a phase separator with a radial gap and three control elements distributed over the circumference.

In the embodiment shown in FIG. 3, only the parts forming the radial gap 3 as well as another drive for setting the gap are shown. To the ring element 2 are fastened, distributed uniformly over the circumference, three setting devices 9 which act on correspondingly associated parts 1.2 which are arranged, uniformly distributed at the circumference of the disc element 1. A control element 9 comprises a yoke 9.1 which is firmly connected to the ring element 2 and encloses a drive 9.2 in the upper region, and the control element 9.3 of which pushes perpendicularly on part 1.2 of the disc element 1. On the side of the part 1.2 opposite the control element 9.3, a spring element 10 is arranged which is braced against the yoke 9.1 and pushes part 1.2 against the control element 9.3. Since three such devices 9 are provided, the surfaces 1.1 and 2.1 forming the radial gap 3 can be adjusted absolutely parallel to each other. The parallelness can be monitored, for instance, capacitively by means of an electrode layer vapor-deposited on one of the gap-forming surfaces.

Figure 4:
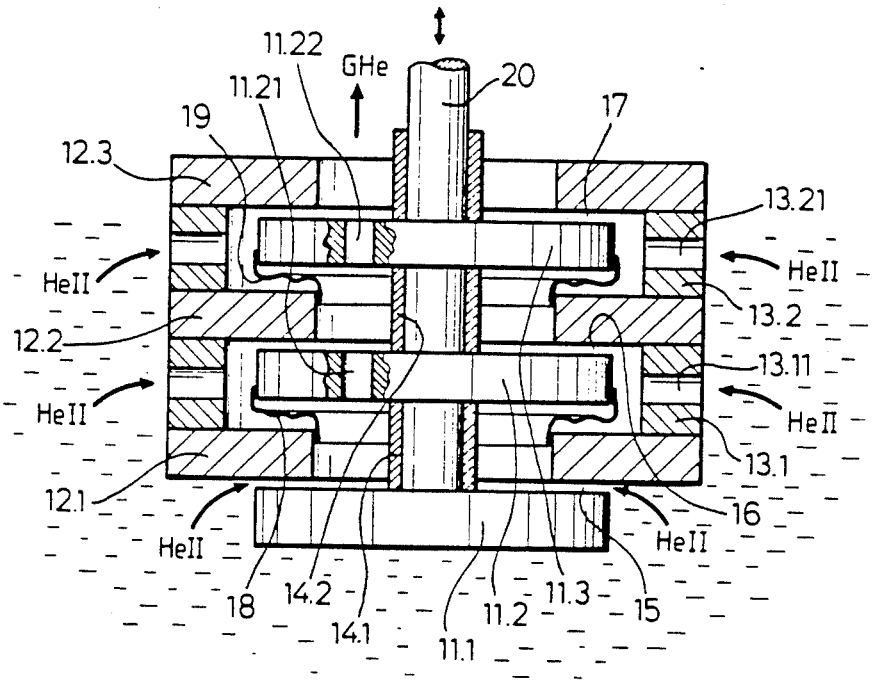
FIG. 4 shows a helium-II phase separator with several radial gaps.

While with the two embodiments described above, only relatively small helium mass streams can be managed, FIG. 4 shows an embodiment, in which a multiplicity of radial gaps can be connected in parallel and the gap widths of which are simultaneously readjusted by a piezoelectric drive. The embodiment shows an arrangement with three radial gaps. The gaps are formed by disc elements 11.1, 11.2, 11.3 and ring elements 12.1, 12.2, 12.3. The ring elements 12.1 to 12.3 are kept at the same spacing by identical spacers 13.1 and 13.2. Likewise, the disc elements 11.1 to 11.3 are kept at the same spacing by two spacer sleeves 14.1 and 14.2. The spacer rings 13.1 and 13.2 have radial holes 13.11 and 13.21 for supplying the helium-II to the radial gaps 16 and 17. The disc elements 11.2 and 11.3 have axial holes 11.21 and 11.22 for the passage of gaseous helium. The disc elements 11.2 and 11.3 are sealed by diaphragm elements 18 and 19 against the ring elements 12.1 and 12.2, with which they do not form controllable radial gaps. The superfluid helium which enters through the openings 13.11 and 13.21, thus cannot circumvent the controllable radial gaps 15 to 17. The disc elements 11.1 to 11.3 are axially adjusted relative to the corresponding ring elements 12.1 to 12.3 via a push rod 20 and a drive, not shown, so that the gap width of the gaps 15 to 17 can be adjusted in the desired range between 0 and 15 μm.

As is readily seen, the flow through the radial gaps in the above-mentioned embodiments need not necessarily be from the outside in; the flow direction of the helium can also be in the reverse direction if the liquid or gas, respectively, is conducted in the appropriate direction.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawing are, accordingly, to be regarded in an illustrative rather than in a restrictive sense.

What is claimed is:

1. A controllable helium-II phase separator comprising suuport means, control means coupled to said support means and at least one capillary gap-shaped canal in communication with a source of superfluid helium-II, said superfluid helium-II flowing in said at least one capillary gap-shaped canal utilizing the cut-off action of the thermomechanical effect, the geometry of said capillary gap-shaped canal being varied by said control means, whereby the gap width of said at least one canal can be changed by varying the distance between two opposite canal walls at least in the range between 0 and 15 μm, said opposite canal walls being formed by surfaces facing each other of at least one cylindrical ring element and at least one disc element, said control means coupled to at least one of the disc element or the ring element in an axial direction of the disc element and ring element.

2. The helium-II phase separator recited in claim 1, wherein the control means comprises a solid-state drive means.

3. The helium-II phase separator recited in claim 2 wherein the solid-state drive means comprises piezoelectric drive means.

4. The helium-II phase separaor recited in claim 1, further comprising at least two coaxially arranged pairs of ring and disc elements, where the respective disc element of a pair is connected in a gastight manner to an inner rim of an opposite ring element via a flexible diaphragm element, and wherein passage openings for gaseous or liquid helium are provided in the disc elements and between the ring elements.

5. The helium-II phase separator recited in claim 4, wherein the disc elements are connected rigidly to each other and can be moved jointly axially by means of a control means.

* * * * *